United States Patent [19]

Johansen et al.

[11] Patent Number: 4,724,436

[45] Date of Patent: Feb. 9, 1988

[54] DEPOLARIZING RADAR CORNER REFLECTOR

[75] Inventors: Elmer L. Johansen, Ann Arbor; Albert Fromm, Ypsilanti, both of Mich.

[73] Assignee: Environmental Research Institute of Michigan, Ann Arbor, Mich.

[21] Appl. No.: 909,692

[22] Filed: Sep. 22, 1986

[51] Int. Cl.[4] ..... H01Q 15/18

[52] U.S. Cl. ..... 342/7; 350/370

[58] Field of Search ..... 347/7; 342/912

[56] References Cited

U.S. PATENT DOCUMENTS

| | | | |
|---|---|---|---|
| 2,697,828 | 12/1954 | Heintz | 342/7 |
| 2,746,035 | 5/1956 | Norwood | 342/7 |
| 4,072,948 | 2/1978 | Drew et al. | 342/7 |
| 4,104,634 | 8/1978 | Gillard et al. | 342/7 |
| 4,241,349 | 12/1980 | Connell | 342/7 |

*Primary Examiner*—Thomas H. Tarcza
*Assistant Examiner*—Donald E. Hayes, Jr.
*Attorney, Agent, or Firm*—Krass and Young

[57] ABSTRACT

A corner radar reflector that backscatters cross-polarized returns from a linearly polarized source is formed by three mutually perpendicular surfaces forming a concave structure. At least one of the surfaces has a depolarizing characteristic. The depolarizing surface is comprised of a grid of thin mutually parallel wires closed spaced. These wires reflect the parallel tangential component of the incident field but do not reflect the orthogonal component. Beneath the wires is a sheet of microwave absorbing material to absorb the energy that was not reflected by the wire grid.

11 Claims, 3 Drawing Figures

DEPOLARIZING RADAR CORNER REFLECTOR

BACKGROUND OF THE INVENTION

Corner reflectors are used with radar systems in a variety of ways such as to align the systems and provide measurements of the effectiveness of the system. They constitute high reflectivity (high radar cross section) targets that can be located in the radar examined field or attached to other targets to assist in location and identification of the targets.

Corner reflectors are used because they reflect incident radiation directly back to the source, independently of the angle of the incidence of the radiation on the reflector.

When a linearly polarized radar source is used, it is desirable that the reflector reflect a cross-polarized signal back to the radar unit when the radar has a cross-polarized channel. One method of increasing the reflected energy from a corner reflector, by causing the incident linearly polarized beam to be reflected in a cross polarized manner, is disclosed in U.S. Pat. No. 3,309,705. That patent discloses a corner reflector having a cross polarizing plate covering the opening in the corner reflector. While this arrangement increases the radar cross section of the reflector it does not provide a uniform strength reflection independent of the angle of incident of the beam but rather produces a high spike of energy if the incident beam is normal to the faceplate. This makes it difficult to obtain reliable measurements when the reflector is being used to align a radar system. Another drawback of the system of U.S. Pat. No. 3,309,705 is that energy is lost when the incident radar waves pass through the depolarizing plate on the way to the reflector and more energy is lost when the reflected wave passes back through the depolarizer. Additionally, the cross polarizing faceplate causes reverberation between the corner reflector and the faceplate.

The present invention is accordingly directed to a corner reflector operative to reflect cross-polarized signals to linearly polarized radar sources which produces uniform reflection independent of the angle of incidence and minimizes the losses within the reflector.

SUMMARY OF THE INVENTION

These and other objects of the present invention, which will become apparent upon a reading of the following specification and claims, are achieved by a corner reflector arrangement consisting of three mutually perpendicular reflective surfaces, one of which is a depolarizing surface. The three surfaces can be triangular, square or round. The depolarizing surface preferably consists of parallel wires supported by a microwave absorbing sheet. The spacing of the parallel wires must be much smaller than the wavelength of the incident beam. The wires are parallel to one edge of the reflective surface. The parallel wires reflect the parallel tangential component of the incident beam on the depolarizing surface, but do not reflect the orthogonal tangential component. In the preferred embodiment the wire grid is supported by a sheet of microwave absorbing material, therefore most of the energy that passes through the wire grid is absorbed by the microwave absorbing sheet. This prevents the orthogonal tangential component from contributing to the reflected beam.

When linearly polarized radiation within the radar bandwidth is directed toward the reflector, the beam bounces off all three surfaces including the depolarizing surface. The reflection from the depolarizing surface will have a different polarization than the reflection from the metal sides. The original beam can be considered as containing six sub-components, each of which will bounce off the relative surfaces in a different order. For example, if the reflective surfaces are labeled A, B, and C, then the incident beam can be considered to contain components ABC, ACB, BCA, BAC, CAB, and CBA. The sub-component name indicates the order of reflection: ABC will first strike surface A, then B, and finally C.

When the phase shift of each reflection is considered in conjunction with the action of the depolarizing surface, the six sub-beams combine into one aggregate return beam which will contain a horizontally and vertically polarized component. The radar cross section of this corner reflector is high and contains a large cross polarized component over a wide range of angles of the incident beam with respect to the corner reflector.

Other objectives, advantages and applications of the present invention will be made apparent by the following detailed description of a preferred embodiment of the invention. The description makes reference to the accompanying drawings in which:

DETAILED DESCRIPTION OF THE SPECIFIC EMBODIMENT

Figure 1:
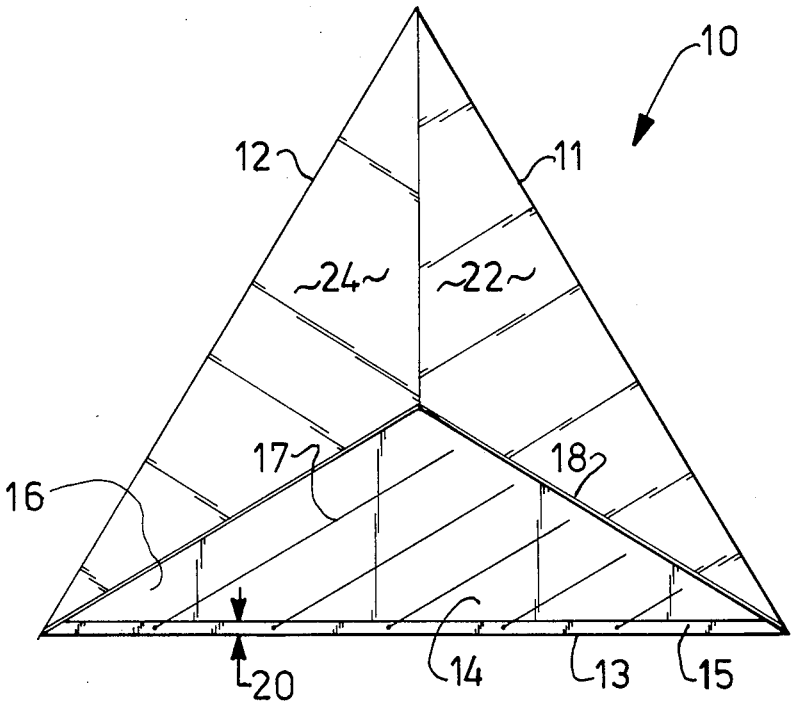
FIG. 1 is a side elevational view of a preferred embodiment of the invention, taking the form of a triangular corner reflector.

Referring to FIG. 1, a corner reflector, generally indicated at 10, constitutes a concave structure formed by three mutually perpendicular rigid plates intersecting one another along three lines having a common point. Each plate comprises two triangular surfaces (faces): one exterior with respect to the concave structure, and one interior with respect to the concave structure. The three exterior edges of the corner reflector 11, 12, and 13, consist of the side of the triangle opposite the ninety degree angle.

The embodiment of FIG. 1 employs a depolarizing reflective surface, 14, and two non-depolarizing reflective surfaces, 22 and 24, preferably formed of metal. In alternative embodiments of the invention, the corner reflector might have two or more depolarizing reflective surfaces. The depolarizing reflective surface 14, and the two non-depolarizing reflective surfaces 22, and 24, are mutually perpendicular, and are interior to the concave structure of the corner reflector.

The depolarizing surface, generally indicated at 14, is a multilayer structure. The topmost layer, 16, is a grid of metallic wires preferably of a metal that has high conductivity such as copper. All of the wires are mutually parallel to line 17, and all of the wires are mutually perpendicular to line 18. The wires are 0.06 CM or less in diameter and are each spaced no more than 0.4 CM apart for X band radar transmission. The spacing is measured by locating any point of any of the wires and then measuring the distance between that point and the closest point on any adjacent wire. Linearly proportional spacing is required for other radar and microwave bandwidths. For example, radar bandwidths with frequencies ten times greater than X band frequencies would require spacing of 0.04 CM between the wires because of the proportionally smaller wavelength due to the higher frequency.

A triangular sheet of microwave absorbing material 15, such as Emerson and Cumming ANW-73, is supported beneath the metallic wires. In alternative embodiments of the invention other dielectric materials can be used such as printed circuit board laminates. The microwave absorbing sheet absorbs radiation that is directed toward the depolarizing surface 14, but that is not reflected by the metal wires. In addition, the microwave absorbing sheet serves to minimize electrical and mechanical interaction between the wires and the structure beneath the wires. In the preferred embodiment the microwave sheet measures about 0.95 CM in height as measured from a point on the interior face of the depolarizing reflective surface 14, to a point directly below on the exterior face of the corner reflector 20. However, microwave absorbing sheets with different absorbing characteristics would require a different thickness. Perpendicular to the depolarizing surface are two non-depolarizing reflective surfaces 22 and 24. These reflective surfaces are preferably metallic and constitute the two remaining interior faces of the corner reflector.

The corner reflector is useful for systems that can measure both a parallel linearly polarized return beam and a cross-polarized linearly polarized return beam. Referring to FIG. 1, in the case of a cross polarized radar system, a linearly polarized radar beam is directed toward the corner reflector. A significant portion of the energy will eventually be reflected to all three sides including the the depolarizing surface. When the radar beam stikes the depolarizing surface, the parallel wires on the depolarizing surface 14 reflect the parallel tangential component of the incident beam on the depolarizing surface 14, but do not reflect the orthogonal tangential component. Since the wire grid is supported by a sheet of microwave absorbing material 15, most of the energy that passes through the wire grid 16 is absorbed by the microwave absorbing sheet 15, thus eliminating the orthogonal tangential component from contributing to the reflected beam.

When linearly polarized radiation within the radar bandwidth is directed toward the reflector, the beam bounces off all three surfaces including the depolarizing surface. The reflection from the depolarizing surface will have a different polarization than the reflection from the metal sides. The original beam can be considered as containing six sub-components (rays), each of which will bounce off the reflective surfaces in a different order. For example, if the reflective surfaces are labeled A, B, and C, then the incident beam can be considered to contain components ABC, ACB, BCA, BAC, CAB, and CBA. The sub-component name indicates the order of reflection: ABC wil first strike surface A, then B, and finally C. When the phase shift of each reflection is considered in conjunction with the action of the depolarizing surface, the six sub-beams combine into one aggregate return beam which will contain a horizontally and vertically polarized component. Like an ordinary corner reflector, the radar cross section of this corner reflector is high. In addition the radar cross section of this corner reflector contains a large cross-polarized component over a wide range of angles of the incident beam with respect to the corner reflector.

Figure 3:
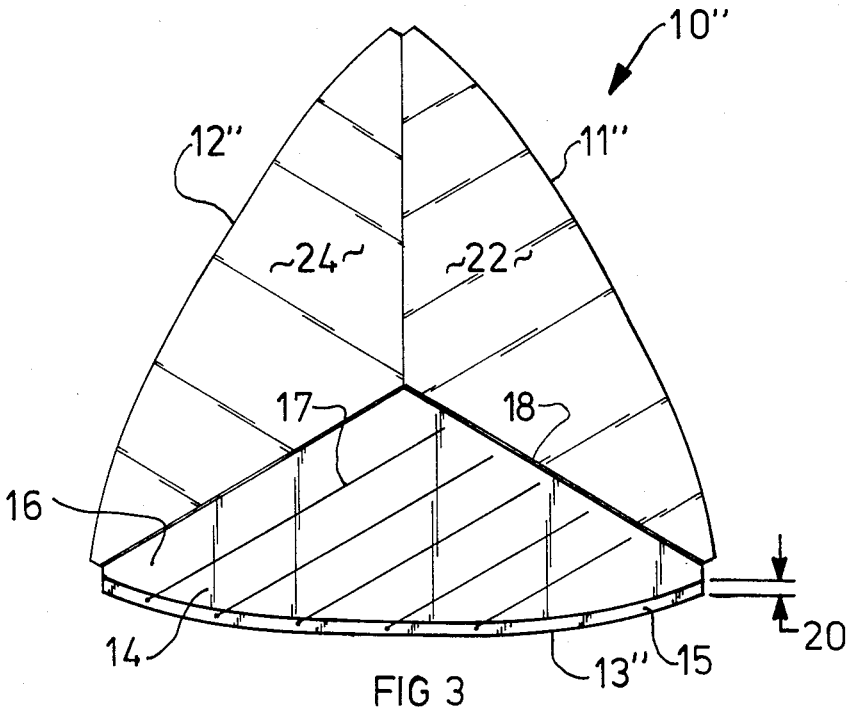
FIG. 3 is a side elevational view of another alternative embodiment of the invention in the form of a circular corner reflector.
Figure 2:
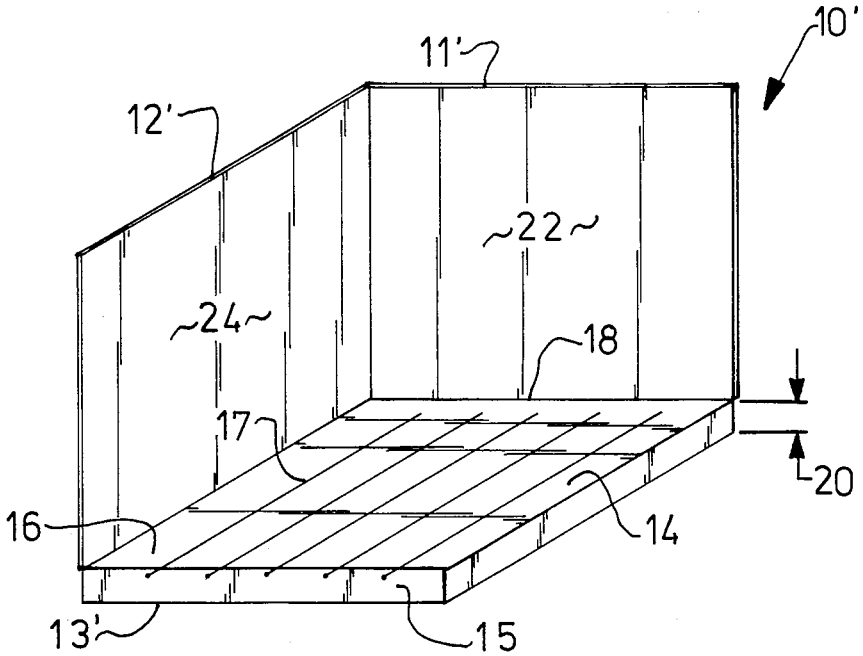
FIG. 2 is a side elevational view of an alternative embodiment of the invention consisting of a square corner reflector.

FIGS. 2 and 3 illustrate alternative embodiments of the corner reflector of the present invention. Corner reflector 10' illustrated in FIG. 2 includes square faces 14, 22, and 24. Face 14 is a depolarizing reflective surface and includes the wire grid 16 and absorbing layer 15. Corner reflector 10'' includes depolarizing reflective face 14, and two non-depolarizing reflective faces 22 and 24, each in the form of a triangle with a rounded exterior edge 11'', 12'', and 13'', respectively. Other portions of the corner reflectors illustrated in FIGS. 2 and 3 are identical to FIG. 1. From these alternative embodiments it should be understood that the shape of the three exterior edges is not critical to the present invention.

What is claimed is:

1. A passive reflector for use with a linearly polarized radar system comprising a concave structure formed by three mutually perpendicular planar surfaces intersection one another along three lines having a common point, at least one of the surfaces being a depolarizing surface having a directional reflective characteristic for substantially reflecting linearly polarized incident radar radiation having a predetermined direction of polarization and substantially absorbing linearly polarized incident radar radiation having a direction of polarization perpendicular to said predetermined direction of polarization and the other surfaces being non-depolarizing surfaces having a non-directional reflective characteristic with regard to linearly polarized incident radar radiation, whereby linearly polarized radiation incident on one of said surfaces is reflected to a second surface, then to a third which reflects it in the reverse direction of the incident radiation to form a return beam having a high cross-polarized component.

2. The reflector of claim 1 wherein said depolarizing surface having a directional reflective characteristic consists of closely spaced parallel wires disposed to said predetermined direction of polarization on an insulating sheet.

3. The passive reflector of claim 2 wherein the orientation of the wires is perpendicular to one of the lines of intersection between the plane of said directional reflective surface with a second of the reflective surfaces and parallel to the line of intersection between the plane of said directional reflective surface with the third reflective surface.

4. The passive reflector of claim 2 wherein said insulating sheet consists of a microwave absorbing material.

5. The passive reflector of claim 2 wherein said depolarizing surface having directional reflective characteristic comprises closely spaced parallel wires disposed parallel to said predetermined direction of polarization supported on a layer of microwave absorbing material.

6. The reflector of claim 1 wherein said reflective surfaces are comprised of triangular regions.

7. The reflector of claim 1 wherein said reflective surfaces are comprised of square regions.

8. The reflector of claim 1 wherein each said reflective surface is comprised of a rounded edge that does not intersect the other two reflective surfaces.

9. A passive reflector for electromagnetic radiation comprising:

a first planar surface having a depolarizing reflectance characteristic whereby incident radiation of differing linear polarizations is reflected in differing magnitudes;

a second planar surface disposed perpendicular to said first planar surface having a non-depolarizing reflectance characteristic whereby incident radiation of differing linear polarizations is reflected in substantially the same magnitude; and a third planar surface disposed perpendicular to both said first planar surface and said second planar surface having a non-depolarizing reflectance characteristic whereby incident radiation of differing linear polarizations is reflected in substantially the same magnitude.

10. The passive reflector as claimed in claim 9, wherein:

said first planar surface includes a plurality of parallel wires having a mutual spacing which is small in comparison to the wavelength of expected incident radiation for substantially reflecting incident radiation having a linear polarization parallel to said parallel wires and for substantially absorbing incident radiation having a linear polarization perpendicular to said parallel wires.

11. The passive reflector as claimed in claim 10, wherein:

said first planar surface further includes an insulating material for supporting said parallel wires, said insulating material having a characteristic for absorbing incident radiation having the same wavelength as the expected incident radiation.

* * * * *

UNITED STATES PATENT AND TRADEMARK OFFICE

CERTIFICATE OF CORRECTION

PATENT NO. : 4,724,436

DATED : February 9, 1988

INVENTOR(S) : Johansen et al

It is certified that error appears in the above-identified patent and that said Letters Patent is hereby corrected as shown below:

Abstract, line 7, "closed" should be --closely--.

Column 2, line 5, "relative" should be --reflective--.

Signed and Sealed this

Eleventh Day of October, 1988

*Attest:*

*Attesting Officer*

DONALD J. QUIGG

*Commissioner of Patents and Trademarks*